US006838676B1

(12) United States Patent
Jackson

(10) Patent No.: US 6,838,676 B1
(45) Date of Patent: Jan. 4, 2005

(54) PARTICLE BEAM PROCESSING SYSTEM

(75) Inventor: Gerald P. Jackson, Lisle, IL (US)

(73) Assignee: HBar Technologies, LLC, West Chicago, IL (US)

( * ) Notice: Subject to any disclaimer, the term of this patent is extended or adjusted under 35 U.S.C. 154(b) by 0 days.

(21) Appl. No.: 10/623,754

(22) Filed: Jul. 21, 2003

(51) Int. Cl.[7] ..... G21G 5/10; G21K 5/04

(52) U.S. Cl. ..... 250/396 R; 250/294; 250/298; 250/307

(58) Field of Search ..... 250/396 R, 294, 250/298, 307, 396, 492.3; 315/507

(56) References Cited

U.S. PATENT DOCUMENTS 5,440,133 A * 8/1995 Moyers et al. ..... 250/492.3
6,433,336 B1 * 8/2002 Jongen et al. ..... 250/305
2004/0056212 A1 * 3/2004 Yanagisawa et al. .... 250/492.1

FOREIGN PATENT DOCUMENTS

JP 2001-000562 * 1/2001

* cited by examiner

*Primary Examiner*—John R. Lee
*Assistant Examiner*—James J Leybourne
(74) *Attorney, Agent, or Firm*—Peter K. Trzyna, Esq.

(57) ABSTRACT

A method for slowing and controlling a beam of charged particles includes the steps of superimposing at least one magnetic field on a mass and passing the beam through the mass and at least one magnetic field such that the beam and the mass slows but does not stop the particles. An apparatus for slowing and controlling a beam of charged particles includes a bending magnetic field superimposed on a focusing magnetic field within a mass.

67 Claims, 4 Drawing Sheets

PARTICLE BEAM PROCESSING SYSTEM

I. BACKGROUND OF THE INVENTION

A. Field of the Invention

This invention relates to the field of particle beams. More particularly, the present invention relates to the control of particle beams by modifying the size, divergence, direction, mean kinetic energy, and kinetic energy distribution of said particle beams. Even more specifically, the present invention addresses the extraction and deceleration of antiprotons from a synchrotron.

B. Background of the Invention

Charged particle beams are typically accelerated in linear accelerators, cyclotrons, or synchrotrons. It is often desirable to extract some or all of these charged particles and to transport them at a kinetic energy lower than the beam energy just prior to extraction. For example, a synchrotron can be used to decelerate a charged particle beam. One option pursued in synchrotrons has been to use a curved silicon crystal to guide the particles out of the accelerator and simultaneously lower the beam energy via collisions with the electrons in the crystal material. See, for example, R. A. Carrigan Jr., G. P. Jackson, et al, "Extraction from TeV-Range Accelerator using Bent Crystal Channeling", Nucl. Instr. and Methods in Phys. Research B90, 128 (1994); C. T. Murphy, G. P. Jackson, et al, "First Results from Bent Crystal Extraction at the Fermilab Tevatron", Nucl. Instr. and Methods in Phys. Research B119, 231 (1996); A. Assev, G. P. Jackson, et al, "First Observation of Luminosity—Driven Extraction using Channeling with a Bent Crystal", Physical Review Letters—Special Topics: Accelerators and Beams Vol. 1, 022801 (1998); and R. A. Carrigan Jr., G. P. Jackson, et al, "Beam Extraction Studies at 900 GeV using a Channeling Crystal", Physical Review Special Topics: Accelerators and Beams Vol. 5, 043501 (2002). A second option has been to use a dipole switch magnet to steer the beam into the desired transport channel, or transfer line. See, for example, Y. K Tai, et. al., "Neutron Yields from Thick targets Bombarded by 18- to 32- MeV Protons", Phys. Rev. Vol.109, No.6, p.2086 (1958). For example, proton therapy treatment centers use dipole switch magnets to steer the beam between a number of patient treatment rooms, as in U.S. Pat. No. 4,870,287, which is incorporated by reference. Depending on the application, there is sometimes a block of material embedded in a transport channel to decelerate the particles to lower kinetic energies, again through collisions with the electrons in the material. See, for example, D. H. Perkins, "Introduction to High Energy Physics", 4th Ed., (Cambridge University Press, 2000), p.349.

A third option, generally utilized in synchrotrons, involves fast-risetime "kicker" bending magnets to deflect the particles down an alternative beam transport channel. See, for example, A. Faltens and M. Giesch, "Fast Kicker Magnets for the 200 GeV Accelerator", IEEE Trans. Nucl. Sci., p.468, June 1967. The junction between this extraction channel and the rest of the accelerator is typically the site of a Lambertson magnet, which introduces an additional bending magnetic field in either the extraction channel or along the accelerator trajectory. See, for example, M. P. May, G. W. Foster, G. P. Jackson, and J. T. Volk, "The Design and Construction of the Permanent Magnet Lambertson for the Recycler Ring at Fermilab", Proc. U.S. Part. Acc. Conf., p.3280 (1997). The use of Lambertson magnets have been established in previous patents, such as U.S. Pat. No. 4,870,287, which is incorporated by reference. It is only after this Lambertson magnet use that a block of material is imposed into the path of the particles and energy reduction or "degrading" is accomplished.

When a charge particle travels through a block of material, a reduction in kinetic energy occurs because of collisions with the electrons in the material For example, such degraders are routinely used to set the dose depth during cancer therapy with protons, as in U.S. Pat. No. 6,034,377, which is incorporated here by reference. See also, for example, Y. Jongen, et. al., "Process Report on the Construction of the Northest Proton Therapy Center (NPTC) Equipment", Proc. U.S. Part. Acc. Conf., p.3816 (1997); E. Pedroni, et. al., "A Novel Gantry for Proton Therapy at the Paul Scherrer Institute", CP600, Cyclotrons and Their Applications 2001, Sixteenth International Conference, edited by F. Marti (2001, American Institute of Physics 0-7354-0044-X), p.13; and A. Yamaguchi, et. al., "A Compact Proton Accelerator System for Cancer Therapy", Prc. U.S. Part. Acc. Conf., p.3828 (1997).

Another embodiment of such a degrader is described in U.S. Pat. No. 6,433,336, which is also incorporated by reference. Unfortunately, at the same time the charged particles also endure collisions with the nuclei within the material. See, e.g., D. H. Perkins. These nuclear collisions cause the particles of the beam to disappear or scatter into a rapidly diverging cloud. For this reason degraders tend to be thin and have specialized optics surrounding them that are more tolerant of the increased beam divergence.

The focusing or converging of charged particle beams is generally accomplished with magnetic lenses that generate either a quadrupole field transverse to the direction of beam travel, solenoid magnets that generate a uniform magnetic field in the direction of beam travel, or lenses which are composed of an electric current flowing with the beam. Quadrupole and solenoid magnets have been used for decades to modify the size and divergence of charge particle beams. See, for example, E.Courant & H. Snyder, Annals of Physics, vol. 3, p.1 (1958). For example, these types of converging magnets are used to focus proton beams onto cancer therapy patients, as described in U.S. Pat. No. 6,034,377, already incorporated by reference.

There are two classes on focusing lenses that are formed by an electric current that flows coincidently with the charged particle beam. The first is another charged particle beam that travels through vacuum concurrently inside the beam that is to be focused. See, for example, G. Jackson, "Tune Spectra in the Tevatron Collider", Proc. U.S. Part. Acc. Conf., p.861 (1989);N. Solyak, et. al., "Electron Beam System for the Tevatron Electron Lens", Proc. U.S. Part. Acc. Conf., p.1420 (2001). The other class of lens passes an electric current through a solid, liquid, or ionized gas or plasma while the charged particle beam is simultaneously passing through the material. See respectively, for example, S. O'Day and K. Anderson, "Electromagnetic, Thermal and Structural Analysis of the Fermilab Antiproton Source Lithium Collection Lens", Proc. U.S. Part. Acc. Conf. (1995); A. Hassanein, et. al., "The Design of a Liquid Lithium Lens for a Muon Collider", Proc. U.S. Part. Acc. Conf., p.3062 (1999); G. Hnimpetinn, et. al., "Experimental Demonstration of Plasma Lens Focusing", Proc. U.S. Part. Acc. Conf., p.3543 (1993).

There are two ideas for a system in which any two of the degrading, steering, and focusing functions are simultaneously implemented. The first is the use of a lithium lens to simultaneously focus and decelerated muon beams. See, for example, A. Hassanein, et. al. This idea is believed to be purely theoretical and no one has shown a way to actually make and use this idea. The second idea is to use magnetization of shielding steel in particle physics calorimeters in order to bend secondary particles that emanated from an atom-smashing event. In this case, the charged particles are in an amorphous cloud, and not in a classical charged particle beam.

One of the uses of degraded charged particle beams is their storage and transportation in containers. For example, a Penning trap can be used to transport antiprotons, as described in U.S. Pat. No. 6,576,916 B2 and incorporated here by reference.

II. SUMMARY OF THE INVENTION

One aspect of the present invention is the superimposing of a focusing magnetic field on a charged particle beam while it is losing kinetic energy passing through a material. Whereas the scattering against atomic nuclei in the materials tends to diffuse the beam particles, making the transverse beam size and divergence larger at the far end of the material, the focusing magnetic field tends to diminish this transverse diffusion.

Another aspect of the present invention is the superimposing of a second magnetic field that steers the charged particle beam. The simultaneous bending and focusing of a charged particle beam reduces the size of the overall beam processing system, reduces costs, and reduces the dependence of the bending angle out of the system on the kinetic energy of the charged particles.

The present invention includes an article of manufacture as well as both an apparatus for achieving the above functionality and the underlying methods for making and using the invention, and product produced thereby. In addition, some of the specific applications for using this apparatus are incorporated as methods covered by the invention disclosure.

III. BRIEF DESCRIPTION OF THE DRAWINGS

IV. DESCRIPTION OF THE PREFERRED EMBODIMENT

Figure 1:
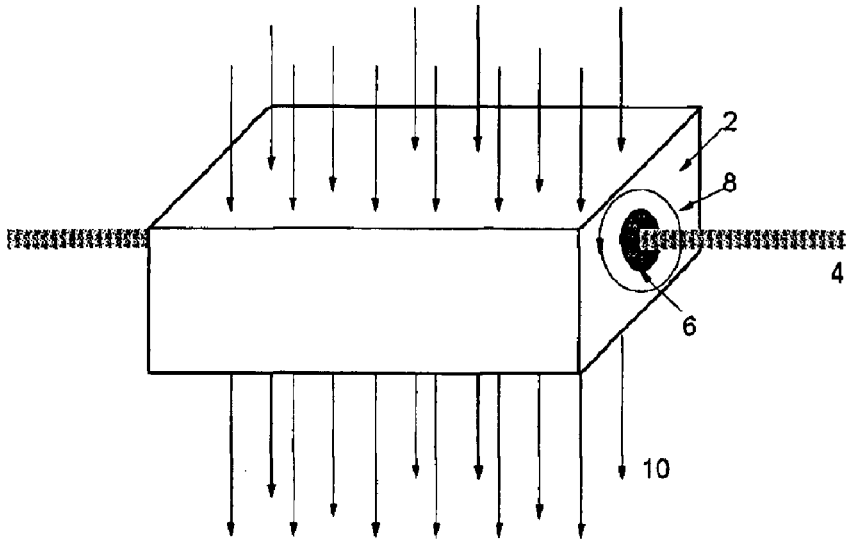
FIG. 1 is a schematic representation of the concept in accordance with the present invention.

FIG. 1 is a schematic representation of the invention. In order to achieve a reduction in the kinetic energy of a charged particle beam 4, preferably antiprotons. The beam 4 is directed through a mass 2. This mass 2 can be composed of a variety of materials, and can be solid, liquid, gas, or a combination thereof. The mass 2 can have a solid shell to hold a liquid and/or gas. Steering of the beam 4 is accomplished by superimposing a bending magnetic field 10 through the material at a non-zero angle with respect to the trajectory of the charged particle beam 4.

The length and composition of the mass 2 is determined so as to rapidly decelerate the charged particle beam 4 to a desired output kinetic energy. The rate of deceleration can be higher than 100 MeV per centimeter by using solid uranium as the mass 2. Whereas traditional electromagnetic methods of accelerating and decelerating charged particle beams require significant power to create the electromagnetic fields, the mass 2 can decelerate or degrade the energy of the beam 4 with less than one Watt of power. This and other embodiments contemplated herein slow, but do not stop, the particles in beam 4. In order to offset the increase in beam divergence caused by collision with the atomic nuclei in the mass 2, focusing of the beam 4 is accomplished by superimposing a focusing magnetic field 8 in the mass 2. In one embodiment of this invention, a circular or azimuthal focusing magnetic field 8 is created by concurrently passing an electrical current 6 through the mass 2. The mass 2 can be a variety of materials 46 running the length of the mass 2 in the direction of the beam 4 and capable of carrying the electrical current 6. Alternatively, this focusing magnetic field 8 can be non-circular. In either case, the focusing magnetic field 8 can be composed of magnetic field lines that are at a non-zero angle to the beam 4. The entire mass 2 can carry this electrical current 6, an electrically insulated portion of the mass 2 can carry this electrical current 6, or the electrical current 6 can be split up into a plurality of substantially parallel conductors 46 running the length of the mass 2 in the direction of the beam 4. Two or more materials can be combined to carry the electrical current 6 and compose the mass 2. In another embodiment of this invention, a quadrupole field configuration used to focus the beam in either the horizontal or vertical direction is generated by splitting this electrical current 6 into separate conductors in a pattern of varying strength and polarity.

The means for superimposing the focusing magnetic field 8 can be an electrical current 6 along the mass 2 in the direction of the charged particle beam 4, or the means for superimposing can be permanent magnet material composing the mass 2. In either case the amount of electrical power required to generate a field of one Tesla per meter squared over at least a three inch diameter can be less than 1000 Watts per meter of beam travel through the mass 2.

Figure 2:
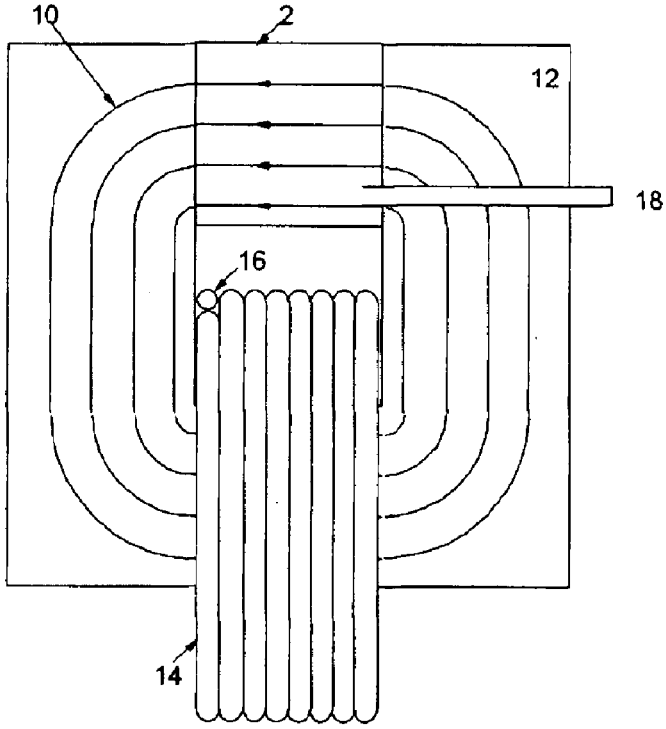
FIG. 2 is the charged particle beam's view of an embodiment of this invention, showing the bending magnetic field lines.

It is preferable to carry out the slowing of the particles at a rate of more than 0.1 million electron-volts per centimeter; for example, by focusing the beam 4 of particles with a focusing magnetic field of at least one Tesla per meter squared over at least a three inch diameter with a power of less than 100 Watts per meter of beam travel through the material; and bending the particle beam with a bending magnetic field 10 of at least one Tesla over at least a three inch diameter with a power of less than 50 Watts per meter of beam travel through the material; a rate of more than one million electron-volts per centimeter; and a rate of more than 10 million electron-volts per centimeter; still better isat a rate of more than 100 million electron-volts per centimeter. In the foregoing, preferable ranges can include slowing is carried out with less than one Watt of power, a power of less than 1000 Watts per meter of beam travel through the material, or a power of less than 500 Watts per meter of beam 4 travel through the maass 2. FIG. 2 shows an embodiment of this invention in which the bending magnetic field 10 is generated by a coil of electrical conducting material 14. Figure shows the mass 2 from the perspective of the oncoming charged particle beam 4. The bending magnetic field 10 is superimposed through the mass 2 by means of a flux return 12 composed of a magnetic material. In another embodiment of this invention permanent magnet material replaces the coil 14 to generate the bending magnetic field 10. By shaping the flux return 12 and positioning the coil 14, the bending magnetic field 10 can be superimposed as a set of uniform straight magnetic field lines at a non-zero angle to the beam 4. Alternatively, the bending magnetic field 10 can be superimposed as a set of non-uniform straight or curved magnetic field lines at a non-zero angle to the beam 4.

The means for superimposing the bending magnetic field 10 can be an electrical current in a coil 14, or the means for superimposing can be permanent magnet material in a gap in the flux return 12. In either case the amount of electrical power required to generate a field of one Tesla over at least a three inch diameter can be less than 500 Watts per meter of beam travel through the mass 2.

Figure 3:
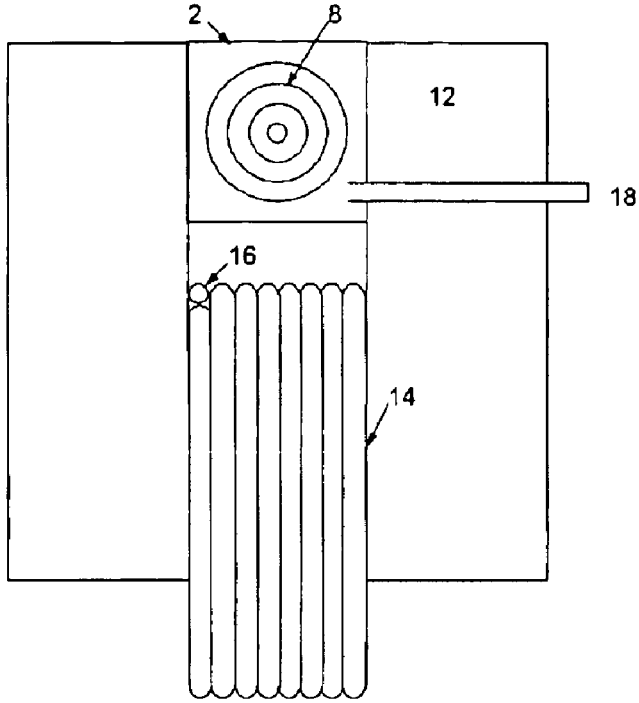
FIG. 3 is the charged particle beam's view of an embodiment of this invention, showing the focusing magnetic field lines.

FIG. 3 shows an embodiment of this invention in which the focusing magnetic field 8 is circular. Alternatively, this focusing magnetic field 8 can be non-circular. This figure shows the mass 2 from the perspective of the oncoming charged particle beam 4. The focusing field 8 is generated by an electrical current 6 that runs along the mass 2 concurrently with the beam 4. This electrical current 6 enters and exits the mass 2 via electrical connectors 18 on either end.

Figure 4:
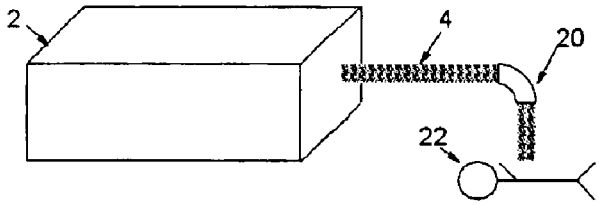
FIG. 4 is a schematic representation of a processed charged particle beam emanating from the material, injected into a transfer line, and onto a patient for the purpose of cancer therapy.

FIG. 4 is a schematic representation of the mass 2 and the decelerated charged particle beam 4 emanating from the mass 2. In this representation the beam 4 is injected into a transfer line 20 that steers and focuses the charged particle beam 4 toward a patient 22 undergoing therapy that includes the termination of cells.

Figure 5:
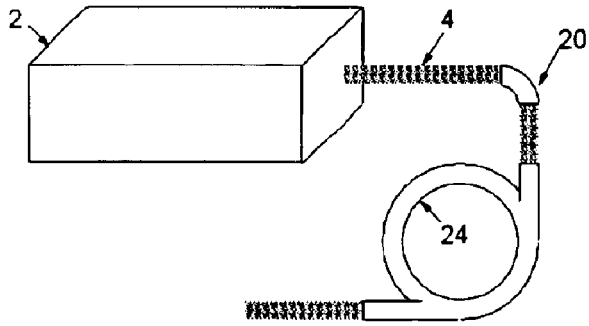
FIG. 5 is a schematic representation of a processed charged particle beam emanating from the material, injected into a transfer line, and into a synchrotron for further deceleration.

FIG. 5 is a schematic representation of the decelerated charged particle beam 4 emanating from the mass 2 and traveling through a transfer line 20. In this schematic representation the beam 4 is then injected into a synchrotron 24 that continues to decelerate the beam 4. See, for example, U.S. patent application Ser. No. 10/408,866,incorporated here by reference.

Figure 6:
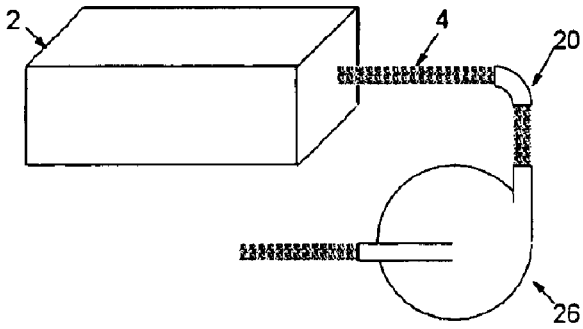
FIG. 6 is a schematic representation of a processed charged particle beam emanating from the material, injected into a transfer line, and into a cyclotron for further deceleration.

FIG. 6 is a schematic representation of the decelerated charged particle beam 4 emanating from the mass 2 and traveling through a transfer line 20. In this schematic representation the beam 4 is then injected into a cyclotron 26 that continues to decelerate the beam 4.

Figure 7:
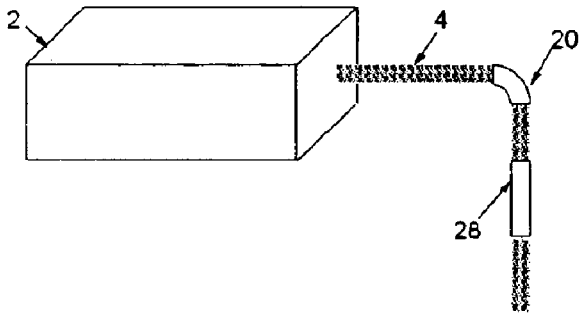
FIG. 7 is a schematic representation of a processed charged particle beam emanating from the material, injected into a transfer line, and into a linear accelerator for further deceleration.

FIG. 7 is a schematic representation of the decelerated charged particle beam 4 emanating from the mass 2 and traveling through a transfer line 20. In this schematic representation the beam 4 is then injected into a linear accelerator 28 that continues to decelerate the beam 4.

Figure 8:
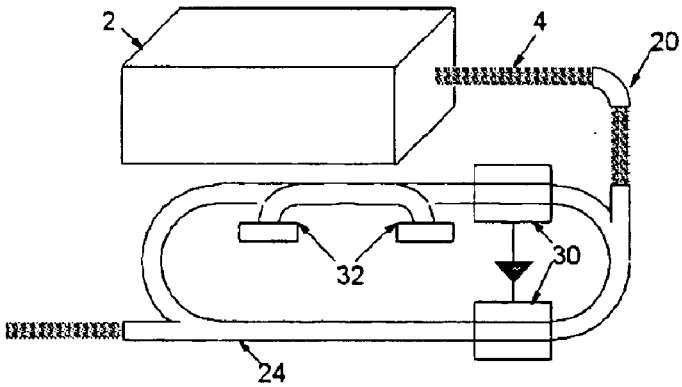
FIG. 8 is a schematic representation of a processed charged particle beam emanating from the material, injected into a transfer line, and into a synchrotron for further deceleration and cooling by means of stochastic cooling, electron cooling, or a combination of the two.

FIG. 8 is a schematic representation of the decelerated charged particle beam 4 emanating from the mass 2 and traveling through a transfer line 20. In this schematic representation the beam 4 is then injected into a synchrotron 24 that incorporates stochastic cooling 30, electron cooling 32, or a combination thereof to reduce the transverse or longitudinal emittances of the charged particle beam 4.

Figure 9:
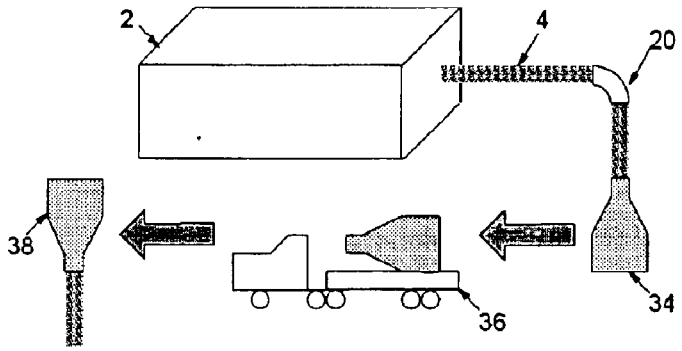
FIG. 9 is a schematic representation of a processed charged particle beam emanating from the material, injected into a transfer line, and into a container that is then transported to a second location where the particles are released.

FIG. 9 is a schematic representation of the decelerated charged particle beam 4 emanating from the mass 2 and traveling through a transfer line 20. In this schematic representation the beam 4 is then injected into a container 34 that is then loaded onto some means of transportation 36. At a second location 38 the charged particles 4 are then released from the container 34.

Figure 10:
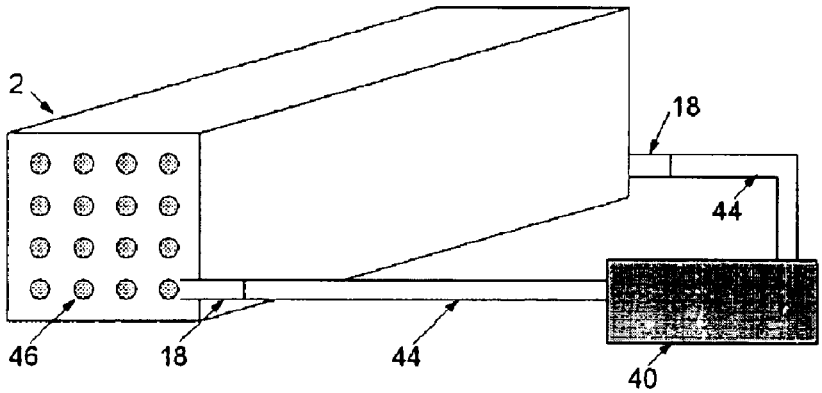
FIG. 10 is a schematic representation of the connections between the mass, which can be composed of a single material or multiple materials running the length of the mass in the direction of the beam, and an electrical power supply.
Figure 11:
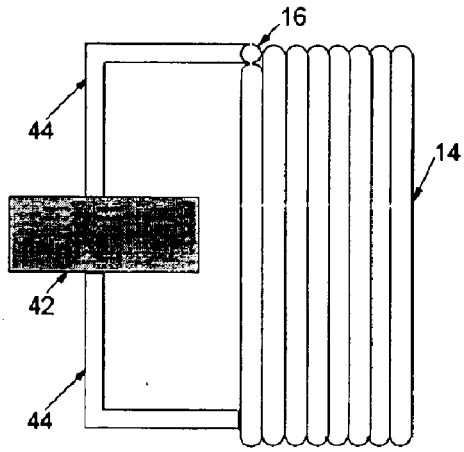
FIG. 11 is a schematic representation of the connections between a bending magnetic field generating coil and an electrical power supply.

FIG. 10 is a schematic representation of one embodiment of this invention in which an electrical power supply 40 sends an electrical current 6 through connections 18 and along the mass 2. This electrical current 6 is the means for superimposing the focusing magnetic field 8 in the mass 2. This electric current 6 can be carried in varying proportions by other materials 46 embedded in the mass 2 and running the length of the mass 2 in the direction of the beam 4. FIG. 11 is a schematic representation of another power supply 42 that is driving an electrical current through the conducting coil 14 which is the means for superimposing the bending magnetic field 10 on the mass 2. As illiustrated in FIG. 10, each of the shaded circles could be a wire embedded down the length of the mass 2. Each wire could be a different material (copper, brass, steel, aluminum, etc.).

The foregoing is a representative teaching of the invention. Thus, the terms and expressions which have been employed herein are used as terms of description and not of limitation, and there is no intention, in the use of such terms and expressions, of excluding equivalents of the features shown and described, or portions thereof, it being recognized that various modifications are possible within the scope of the invention, including corresponding uses in the patents and patent application incorporated by reference herein.

What is claimed is:

1. A method for slowing and controlling a beam of charged particles, the method including the steps of:

superimposing at least one magnetic field on a mass; and passing a beam of the charged particles through the mass and at least one magnetic field such that the fields control the beam and the mass slows but does not stop the particles.

2. The method of claim 1, wherein the step of superimposing includes superimposing a bending magnetic field within the mass.

3. The method of claim 1, wherein the step of superimposing includes superimposing a focusing magnetic field within the mass.

4. The method of claim 1, wherein the step of superimposing includes superimposing a bending magnetic field on a focusing magnetic field within the mass.

5. The method of claim 4, wherein the step of passing is carried out with the mass including a gas.

6. The method of claim 4, wherein the step of passing is carried out with the mass including a liquid.

7. The method of claim 4, wherein the step of passing is carried out with the mass including a solid.

8. The method of claim 4, wherein the step of superimposing is carried out with one of the magnetic fields at a non-zero angle to the beam.

9. The method of claim 4, wherein the step of superimposing is carried out with the focusing magnetic field being a circular magnetic field inside the mass.

10. The method of claim 4, wherein the step of superimposing is carried out with the focusing magnetic field being a non-circular magnetic field inside the mass.

11. The method of claim 4, wherein the step of superimposing is carried out with the bending magnetic field being uniform inside the mass.

12. The method of claim 4, wherein the step of superimposing is carried out with the bending magnetic field being non-uniform inside the mass.

13. The method of claim 4, further including the step of flowing an electrical current along a length of the mass to produce the focusing magnetic field.

14. The method of claim 4, further including the step of flowing electrical current in at least one coil adjacent to the mass, the coil located around a material sufficiently magnetic to interact with the current in the coil to influence the bending magnetic field.

15. The method of claim 4, wherein the step of passing the beam of the charged particles through the mass is carried out with the mass comprised of a material conducting an electric current and includes magnetically influencing the beam with the electric current.

16. The method of claim 4, further including the steps of:

directing the beam into a transfer line; and aiming the beam at a patient to terminate cells.

17. The method of claim 4, further including the steps of:

directing the beam into a transfer line;

injecting the beam into a synchrotron; and further decelerating the beam.

18. The method of claim 4, further including the steps of:

directing the beam into a transfer line;

injecting the beam into a cyclotron; and further decelerating the beam.

19. The method of claim 4, further including the steps of:

directing the beam into a transfer line;

injecting the beam into a linear accelerator; and further decelerating the beam.

20. The method of claim 4, further including the steps of:

directing the beam into a transfer line;

injecting the beam into a synchrotron;

reducing the beam emittance longitudinally and/or transversely with stochastic and/or electron cooling; and further decelerating the beam.

21. The method of claim 4, further including the steps of:

directing the beam into a transfer line;

injecting the beam into a synchrotron;

reducing the beam emittance in at least one direction from the group consisting of longitudinally, transversely, and both, with cooling from the group consisting of stochastic, electron, and both; and further decelerating the beam.

22. The method of claim 4, further including the steps of:

capturing the particles in a container at a first location;

transporting the container to a second location; and releasing the particles at the second location.

23. An apparatus for slowing and controlling a beam of charged particles, the apparatus including:

means for superimposing a magnetic field within a mass, and a second means for superimposing a second magnetic field within the mass, said means cooperating to control the beam of particles within the mass; and means for passing a beam of charged particles through the mass to slow the charged particles.

24. An apparatus for slowing and controlling a beam of charged particles, the apparatus including:

a bending magnetic field superimposed on a focusing magnetic field within a mass.

25. The apparatus of claim 24, wherein the mass includes a gas.

26. The apparatus of claim 24, wherein the mass includes a liquid.

27. The apparatus of claim 24, wherein the mass includes a solid.

28. The apparatus of claim 24, further including:

at least one coil adjacent to the mass, the coil located around a flux return sufficiently magnetic to influence the bending magnetic field.

29. The apparatus of claim 28, wherein the mass is comprised of:

a material conducting an electric current to magnetically influence the beam.

30. The apparatus of claim 28, further including:

a supply of electrical power;

electrical connectors on each end of the material; and interconnections between the power supply and the electrical connectors to communicate the electrical power through the material.

31. The apparatus of claim 30, wherein the mass is comprised of:

a second material conducting an electric current to magnetically influence the beam; and further including electrical connectors on each end of each material to communicate electrical power through the respective materials.

32. A method for controlling a beam of particles, the method including the steps of:

slowing the particles with a mass by a rate of more than 0.1 million electron-volts per centimeter;

focusing the beam of particles with a focusing magnetic field of at least one Tesla per meter squared over at least a three inch diameter with a focusing field generated by electrical power of less than 100 Watts per meter of beam travel through the mass; and bending the particle beam with a bending magnetic field of at least one Tesla over at least a three inch diameter with a bending field generated by electrical power of less than 50 Watts per meter of beam travel through the mass.

33. The method of claim 32, wherein the step of slowing is carried out at a rate of more than one million electron-volts per-centimeter.

34. The method of claim 32, wherein the step of slowing is carried out at a rate of more than 10 million electron-volts per centimeter.

35. The method of claim 32, wherein the step of slowing is carried out at a rate of more than 100 million electron-volts per centimeter.

36. The method of claim 32, wherein the step of slowing is carried out with less than one Watt of power.

37. The method of claim 32, wherein the step of focusing is carried out with a focusing magnetic field of at least one Tesla per meter squared over at least a three inch diameter with a power of less than 1000 Watts per meter of beam travel through the material.

38. The method of claim 32, wherein the step of bending is carried out with a bending magnetic field of at least one Tesla over at least a three inch diameter with a power of less than 500 Watts per meter of beam travel through the material.

39. The method of claim 1, wherein the step of passing the beam is carried out with the particles including antiprotons.

40. The method of claim 2, wherein the step of passing the beam is carried out with the particles including antiprotons.

41. The method of claim 3, wherein the step of passing the beam is carried out with the particles including antiprotons.

42. The method of claim 4, wherein the step of passing the beam is carried out with the particles including antiprotons.

43. The method of claim 5, wherein the step of passing the beam is carried out with the particles including antiprotons.

44. The method of claim 6, wherein the step of passing the beam is carried out with the particles including antiprotons.

45. The method of claim 7, wherein the step of passing the beam is carried out with the particles including antiprotons.

46. The method of claim 8, wherein the step of passing the beam is carried out with the particles including antiprotons.

47. The method of claim 9, wherein the step of passing the beam is carried out with the particles including antiprotons.

48. The method of claim 10, wherein the step of passing the beam is carried out with the particles including antiprotons.

49. The method of claim 11, wherein the step of passing the beam is carried out with the particles including antiprotons.

50. The method of claim 12, wherein the step of passing the beam is carried out with the particles including antiprotons.

51. The method of claim 13, wherein the step of passing the beam is carried out with the particles including antiprotons.

52. The method of claim 14, wherein the step of passing the beam is carried out with the particles including antiprotons.

53. The method of claim 15, wherein the step of passing the beam is carried out with the particles including antiprotons.

54. The method of claim 16, wherein the step of passing the beam is carried out with the particles including antiprotons.

55. The method of claim 17, wherein the step of passing the beam is carried out with the particles including antiprotons.

56. The method of claim 18, wherein the step of passing the beam is carried out with the particles including antiprotons.

57. The method of claim 19, wherein the step of passing the beam is carried out with the particles including antiprotons.

58. The method of claim 20, wherein the step of passing the beam is carried out with the particles including antiprotons.

59. The method of claim 21, wherein the step of passing the beam is carried out with the particles including antiprotons.

60. The method of claim 22, wherein the step of passing the beam is carried out with the particles including antiprotons.

61. The method of claim 32, wherein the step of focusing the beam is carried out with the particles including antiprotons.

62. The method of claim 33, wherein the step of focusing the beam is carried out with the particles including antiprotons.

63. The method of claim 34, wherein the step of focusing the beam is carried out with the particles including antiprotons.

64. The method of claim 35, wherein the step of focusing the beam is carried out with the particles including antiprotons.

65. The method of claim 36, wherein the step of focusing the beam is carried out with the particles including antiprotons.

66. The method of claim 37, wherein the step of focusing the beam is carried out with the particles including antiprotons.

67. The method of claim 38, wherein the step of focusing the beam is carried out with the particles including antiprotons.

* * * * *